United States Patent [19]

Holst et al.

[11] 4,171,705

[45] Oct. 23, 1979

[54] CIGARETTE FILTER

[75] Inventors: Arno Holst, Wiesbaden-Biebrich; Michael Kostrzewa, Wiesbaden; Helmut Lask, Wiesbaden-Schierstein, all of Fed. Rep. of Germany

[73] Assignee: Hoechst Aktiengesellschaft, Fed. Rep. of Germany

[21] Appl. No.: 751,629

[22] Filed: Dec. 17, 1976

Related U.S. Application Data

[62] Division of Ser. No. 562,143, Mar. 26, 1975, Pat. No. 4,051,611.

[30] Foreign Application Priority Data

Mar. 28, 1974 [CH] Switzerland ..... 4300/74

[51] Int. Cl.[2] ..... A24B 15/02

[52] U.S. Cl. ..... 131/267; 131/268

[58] Field of Search ..... 131/10 R, 10.7, 261–269, 131/10.9

[56] References Cited

U.S. PATENT DOCUMENTS 3,756,253 9/1973 Honda et al. ..... 131/267

*Primary Examiner*—Robert W. Michell
*Assistant Examiner*—V. Millin
*Attorney, Agent, or Firm*—James E. Bryan

[57] ABSTRACT

This invention relates to a cigarette filter of cellulosic material composed at least partially of modified cellulose modified with at least one fatty acid group containing at least 14 carbon atoms in the molecule selected from the group consisting of a complex compound of a fatty acid containing basic chromium chloride and a melamine resin precondensate containing a fatty acid group.

1 Claim, No Drawings

CIGARETTE FILTER

This is a division, of application Ser. No. 562,143, filed Mar. 26, 1975 now U.S. Pat. No. 4,051,611.

This invention relates to a cigarette filter with an increased tar and nicotine retentivity.

It is known to use cellulosic materials in the manufacture of cigarette filters. Cellulose acetate in particular is widely used with advantage, because filters made of this material are inexpensive and their production involves no technical problems. The tar and nicotine content of cigarette smoke is not substantially reduced by the known filter materials, however.

It is the object of the present invention to provide a cigarette filter which has an improved nicotine and tar retention capacity. In order to achieve this object, use is made of the known cigarette filters of cellulosic material, but the cigarette filter according to the invention is composed at least partially of cellulose which has been modified with organic isocyanates or with higher molecular weight fatty acid groups, or of naturally water-soluble cellulose ethers which have been rendered largely or completely insoluble in water by cross-linking or some other means of modification, but are still capable of adsorbing water.

The modified cellulose which may be used for the production of the cigarette filter according to the invention may be prepared from naturally occurring cellulose or from regenerated cellulose. The organic isocyanates used as modifying agents are preferably bi-valent or poly-valent isocyanates. In many cases, it is possible to react the cellulose with isocyanates in the presence of water, so that no organic solvent need be used as the reaction medium. For example, this is possible in the case of isocyanate compounds prepared by condensing three molecules of a diisocyanate, e.g. three molecules of hexamethylene diisocyanate, and in the case of stearyl isocyanate. In the case of isocyanates which react with aqueous media, the reaction with cellulose may be conducted, for example, in sufficient inert organic solvent, e.g. toluene, that a kneadable reaction mass is produced. Advantageously, the reaction between cellulose and isocyanate is performed at an elevated temperature, for example at a temperature between 80° C. and 110° C., and while the mass is kneaded.

The modification of cellulose by a higher molecular weight fatty acid is preferably achieved by reaction with a higher molecular weight fatty acid, an ester of a higher molecular weight fatty acid, a complex compound of a higher molecular weight fatty acid containing basic chromium chloride, or a melamine resin precondensate containing a higher molecular weight fatty acid group. The higher molecular weight fatty acids of these compounds are fatty acids containing at least 14 carbon atoms in the molecule. The use of these fatty acids and the fatty acid derivatives listed above has the advantage that relatively small quantities of fatty acid compounds are necessary for the modification of the cellulose mass. The modification of cellulose by means of isocyanates and higher molecular weight fatty acids is described in detail in copending application Ser. No. 526,936, filed Nov. 25, 1974, to which reference is made herein now abandoned.

The naturally water-soluble cellulose ethers, rendered largely or completely water-insoluble by cross-linking or some other means of modification, of which the cigarette filters according to the invention may be partially or entirely composed, are those cellulose ethers which are cross-linked or otherwise modified to such a degree that more than 50 percent by weight of the originally virtually completely water-soluble cellulose ether is no longer soluble in water, i.e. remains in the filter as a residue when filtering an aqueous solution or dispersion of the cellulose ether produced by stirring a 2 percent solution thereof in water at 20° C. until all soluble components have dissolved. On the other hand, the degree of cross-linking or modification must be low enough to enable the cross-linked or otherwise modified cellulose ether to adsorb a quantity of water corresponding to at least its own dry weight when it is immersed in water at 20° C.

Carboxymethyl cellulose cross-linked in this manner and a process for its production are described, e.g., in German Offenlegungsschrift No. 1,912,740 and in the corresponding U.S. Pat. No. 3,589,364. According to this process, cellulose fibers are carboxylated in known manner to produce a degree of substitution sufficiently high to render the carboxymethyl cellulose fibers water-soluble without being cross-linked; before, during, or after etherification, however, cross-linking is effected with a cross-linking agent in an inert organic solvent and in the presence of a small quantity of water which must be sufficient to enable the cellulose or cellulose ether fibers to swell. Preferably, epichlorohydrin is used as the cross-linking agent in a quantity between 3 and 10 percent by weight, based on the dry weight of the original cellulose.

The modified carboxymethyl cellulose ethers described in U.S. Pat. Nos. 2,639,239, and 3,723,413, also may be used in accordance with the present invention, provided they correspond to the above definition, i.e. are to more than 50 percent by weight insoluble in water at 20° C., and are capable of adsorbing a quantity of water corresponding to at least their own dry weight.

Another process for the preparation of cross-linked water-soluble cellulose ethers suitable for use in the production of the cigarette filters according to the invention is described in application Ser. No. 522,741, filed Nov. 11, 1974 now U.S. Pat. No. 3,936,441. According to this process, cellulose is reacted with an etherification agent in the presence of an alkali and, as a reaction medium, 0.8 to 7.5 parts by weight of isopropanol, based on the weight of the cellulose, to form carboxymethyl cellulose, carboxymethyl hydroxyethyl cellulose, hydroxyethyl cellulose, or methyl-hydroxyethyl cellulose, the process being such that, if only etherification were carried out, a substantially, i.e. to more than 95 percent by weight, water-soluble cellulose ether would be produced, the process being conducted, however, in a manner such that before, during, or after etherification a reaction occurs with a cross-linking agent, which is either polyfunctional towards cellulose in an alkaline reaction medium, the functional groups being the acrylamido group $CH_2{=}CH{-}\underset{\underset{O}{\|}}{C}{-}\underset{\underset{|}{}}{N}{-}$ the chlorazomethine group $-N{=}\underset{\underset{Cl}{|}}{C}{-}$ or the allyl oxyazomethine group $-N{=}\underset{\underset{|}{}}{C}{-}O{-}CH_2{-}CH{=}CH_2$, or which is dichloroacetic acid or phosphorus oxychloride. The following compounds may be used as the cross-linking agent in the process, for example:

methylene-bis-acrylamide,
N,N'-dimethylol-(methylene-bis-acrylamide),
trisacryloyl hexahydrotriazine,
acrylamido-methylene chloroacetamide,
2,4,6-trichloro pyrimidine,
2,4,5,6-tetrachloro pyrimidine,
cyanuric chloride,
triallyl cyanurate,
dichloroacetic acid, or
phosphorus oxychloride.

Depending upon the nature of the cross-linking agent used, 0.001 to 0.2 part by weight of cross-linking agent is employed per part by weight of cellulose, with the exception of dichloroacetic acid which must be used in quantities of more than 0.1 part by weight per part by weight of cellulose.

A further method for the manufacture of modified cellulose ethers which may be used for the production of cigarette filters according to the invention is described in copending application Ser. No. 524,822, filed Nov. 18, 1974. In this process, which deals with the manufacture of water-adsorbing, but substantially, i.e. by more than 50 percent by weight, water-insoluble cellulose ethers, cellulose is alkalized in the presence of an alkali and, as the reaction medium 0.8 to 7.5 parts by weight of isopropanol, based on the weight of the cellulose, and etherified with an etherification agent to form carboxymethyl cellulose, carboxymethyl hydroxyethyl cellulose, hydroxyethyl cellulose, or methylhydroxyethyl cellulose, the reaction being such that, if only etherification were carried out, a substantially, i.e. at least 95 percent by weight, water-soluble cellulose ether would be formed, but in which before, during or after etherification, the cellulose is further modified with a reaction medium which is capable of a reaction with the free hydroxy groups of the cellulose anhydro glucose groups in an alkaline reaction medium and which corresponds to one of the following formulae:

$$CH_2{=}CH{-}CO{-}NH{-}\underset{\underset{R_2}{|}}{CH}{-}R_1 \text{ or} \qquad \text{I.}$$

$$CH_2{=}CH{-}SO_2{-}NH_2 \qquad \text{II}$$

wherein, in formula I, $R_1$ is a hydroxyl group, an acylamino group, or an esterified carbamino group, and $R_2$ is hydrogen or the carboxy group.

Examples of modifying agents which may be used in this process are:

N-methylol acrylamide,
N-(acrylamido-methylene)-acetamide,
N-(acrylamidomethylene)-formamide,
N-(acrylamido-methylene)-amyl urethane,
N-(acrylamido-methylene)-methyl urethane,
N-(acrylamido-carboxy-methylene)-ethyl urethane,
N-(acrylamido-methylene)-methoxy ethyl urethane, and vinyl sulfonamide.

Up to 100 parts by weight of modifying agent may be used per 100 parts by weight of cellulose, preferably, however, the quantity is less than 25 parts.

For the manufacture of cigarette filters, the materials may be used in any desired form, for example as a granulate, a powder, or as a creped film.

Further, it is possible for the materials to be mixed with the cellulose acetate fibers hitherto used or with other materials, especially cellulose fibers, i.e. either added in fine distribution to the mass from which the fibers are made, or mixed with the fibers in the form of small particles.

The following examples illustrate the superior filtering performance of the cigarette filters according to the invention. Examples 1 to 5 refer to cigarette filters according to the invention. Example 6 refers to a conventional cellulose acetate filter used by the cigarette industry. Example 7 refers to a cellulose filter, and Example 8 to a cigarette without a filter.

For conducting Examples 1 to 5 and 7, cigarette filters were produced from the materials in the natural fiber shape by forcing the fibers into a glass tube so that a filter of 15 mm length was formed. The resistance to air flow (draw resistance) was adjusted so that it corresponded to the value of the cellulose acetate filter provided by a cigarette producer as used in Example 6. The cigarette columns were prepared from a conventional cigarette tobacco mixture and then mechanically smoked off on a standardized smoking machine widely used in the cigarette industry (Type CSM 10, a product of the firm Cigarette Components). In the smoking-off process, 35 ml of air were drawn within 2 seconds every minute through the "cigarette", which corresponds to one draw of a smoker. The entrained smoke (main smoke flow) was analyzed by methods adopted by the cigarette industry (Coresta Standard Methods). The quantities of nicotine and tar contained in the main smoke flow, in milligrams per gram of smoked tobacco, are compiled in the table below. The values given in the table are average values determined after 10 cigarettes each had been smoked off.

EXAMPLE 1

The filters of the smoked-off cigarettes were composed of cellulose which had been modified with 5 percent by weight of a melamine resin precondensate containing stearic acid groups. The filter material was prepared as follows:

20 g of cellulose (particle size below 0.5 mm) were dispersed at 70° C. and while stirring in 150 ml of isopropanol (100 percent) containing 1 g of a stearic acid substituted trimethylol melamine. The mixture was stirred for another 30 minutes at 80° C. and then dried at 100° C. in a drier.

EXAMPLE 2

Example 1 was repeated, except that the cellulose was modified with 10 percent by weight of the stearic acid substituted melamine resin precondensate and, after drying, the modified cellulose was fractionated by sifting and only the fraction containing particles of a size ranging from 0.1 to 0.2 mm was used for the manufacture of the filter.

EXAMPLE 3

The filters of the cigarettes smoked off were composed of cellulose which had been modified with 100 percent by weight of a triisocyanate. The filter material was prepared as follows:

17 g of ground cellulose (particle size below 0.25 mm) were sprayed at room temperature and while stirring with a solution of 17 g of triisocyanate in 20 g of xylene. The resulting mixture was then placed for 30 minutes in a drying oven heated to 120° C. The triisocyanate used was prepared by condensing 3 molecules cf hexamethylene diisocyanate.

EXAMPLE 4

The filters of the cigarettes smoked off was composed of carboxymethyl cellulose which had been cross-linked with 11.25 percent by weight of dichloroacetic acid, based on the original weight of the cellulose. The filter material was prepared as follows:

In a stirring vessel and at room temperature (20° C.), 20 kg of cellulose were alkalized by thorough mixing for 45 minutes with 12.8 kg of caustic soda solution (49.5 percent concentration) in 60 kg of isopropanol (87 percent concentration). A mixture of 10.8 kg of the sodium salt of monochloroacetic acid and 2.25 kg of dichloroacetic acid was then added. While the mass was further mixed, it was heated to 85° C. and mixing was continued for 1 hour at this temperature, during which time the etherification of the alkali cellulose took place. The product thus obtained was finally neutralized, freed from salts by washing, and dried.

EXAMPLE 5

The filters of the cigarettes smoked off were composed of carboxymethyl cellulose which had been cross-linked with 17 percent by weight—calculated on the original weight of the cellulose—of dimethylol methylene bis-acrylamide. The filter material was prepared as follows:

100 g of cellulose were alkalized by kneading for 45 minutes at a temperature of 20° C. in 300 g of isopropanol (87 percent concentration) and 65 g of caustic soda solution (50 percent concentration). The resulting alkali cellulose was then etherified during 1 hour by adding 82 g of the sodium salt of monochloroacetic acid and kneading at a temperature of 70° C. The carboxymethyl cellulose thus produced was then cross-linked by kneading for 1 hour at 50° C., with 50 g of dimethylol-methylene-bisacrylamide (30 percent concentration).

EXAMPLE 6

The filters of the cigarettes smoked off were composed of cellulose acetate. They had been manufactured by a cigarette factory for use in their current production.

EXAMPLE 7

The filters of the cigarettes smoked off were composed of unmodified cellulose.

EXAMPLE 8

The cigarettes smoked off were without filters.

The following table summarizes the results of the tests described in Examples 1 to 8 as far as the nicotine and tar content of the main smoke flow is concerned, the quantities stated being in milligrams per gram of smoked-off cigarette tobacco.

TABLE

| Analyzed Substance | 1 | 2 | 3 | 4 | 5 | 6 | 7 | 8 |
|---|---|---|---|---|---|---|---|---|
| Nicotine | 0.80 | 0.46 | 0.52 | 0.44 | 0.74 | 1.42 | 0.83 | 1.59 |
| Tar | 15.6 | 8.9 | 11.2 | 6.5 | 11.1 | 24.5 | 18.2 | 28.4 |

As can be seen from the table, the cigarette filters according to the present invention are far more effective as regards nicotine and tar adsorption than are the conventional cellulose acetate filters. As compared with the nicotine and tar contents of unfiltered cigarettes (Example 8), the nicotine content of the main smoke flow is reduced by from 50 (Ex. 1) to 72 (Ex. 4) percent, and the tar content by from 45 (Ex. 1) to 77 (Ex. 4) percent. The cellulose acetate filters normally used in the industry (Example 6) reduce the nicotine content by only 11 percent and the tar content by only 14 percent.

Further, it is evident from the table that filters of unmodified cellulose (Example 7) are distinctly inferior to the filters according to the invention as far as nicotine and tar retention are concerned. They retain only 48 percent of the nicotine and 36 percent of the tar.

It will be obvious to those skilled in the art that many modifications may be made within the scope of the present invention without departing from the spirit thereof, and the invention includes all such modifications.

What is claimed is:

1. A cigarette filter of cellulosic material composed at least partially of modified cellulose prepared from naturally occuring cellulose or from regenerated cellulose and being in the form of a granulate, a powder, a creped film or a fiber and modified with at least one fatty acid group containing at least 14 carbon atoms in the molecule selected from the group consisting of a complex compound of a fatty acid containing basic chromium chloride and a melamine resin precondensate containing a fatty acid group.

* * * * *